US005567905A

United States Patent [19]

Barnes et al.

[11] Patent Number: 5,567,905

[45] Date of Patent: Oct. 22, 1996

[54] GAS GENERANT COMPOSITIONS CONTAINING D 1-TARTARIC ACID

[75] Inventors: Michael W. Barnes; Thomas M. Deppert, both of Brigham City; Robert D. Taylor, Hyrum, all of Utah

[73] Assignee: Morton International, Inc., Chicago, Ill.

[21] Appl. No.: 594,079

[22] Filed: Jan. 30, 1996

[51] Int. Cl.[6] ..... C06B 45/12; C06B 29/08

[52] U.S. Cl. ..... 102/289; 264/3.4; 149/2; 149/19.1; 149/83

[58] Field of Search ..... 149/2, 19.1, 35, 149/83; 102/289; 264/3.4

[56] References Cited

U.S. PATENT DOCUMENTS

| | | | |
|---|---|---|---|
| 3,785,149 | 1/1974 | Timmerman | 149/83 |
| 3,827,715 | 8/1974 | Lynch | 102/289 X |
| 3,880,595 | 4/1975 | Timmerman | 149/83 X |
| 3,902,934 | 9/1975 | Timmerman | 149/83 |
| 3,964,255 | 6/1976 | Catanzarite | 149/77 X |
| 4,099,376 | 7/1978 | Japs | 149/19.92 |
| 4,152,891 | 5/1979 | Garner | 149/83 X |
| 4,994,212 | 2/1991 | Vos et al. | 149/35 |
| 5,084,218 | 1/1992 | Vos et al. | 149/35 |
| 5,467,715 | 11/1995 | Taylor et al. | 102/289 |
| 5,498,634 | 3/1996 | Kabasawa | 514/459 |

*Primary Examiner*—Peter A. Nelson

*Attorney, Agent, or Firm*—Wayne E. Nacker; Gerald K. White

[57] ABSTRACT

In gas generant compositions utilizing as fuel, at least in part, tartaric acid, aqueous processing is improved through the use of d,l-tartaric acid over naturally-occurring l-tartaric acid.

3 Claims, No Drawings

GAS GENERANT COMPOSITIONS CONTAINING D 1-TARTARIC ACID

The present invention is directed to gas generant compositions, and particularly to gas generant compositions containing d,1-tartaric acid.

Background of the Invention

U.S. Pat. No. 3,785,149, the teachings of which are incorporated herein by reference, teaches the use of tartaric acid as a fuel in conjunction with an oxidizer, such as potassium perchlorate, as a gas generant for inflation of automotive airbags and the like. This patent teaches compacting powders of tartaric acid and oxidizers to form gas generant compositions.

Tartaric acid is a desirable fuel in gas generant compositions as it contains only the elements hydrogen, carbon and oxygen, and can be used in nitrogen-less gas generant formulations, such as the tartaric acid/potassium perchlorate compositions taught in U.S. Pat. No. 3,785,149. In nitrogen-less compositions, undesirable nitrogen-containing gases, such as $NO_x$ (particularly NO and $NO_2$) and $NH_3$, are not formed. Also, tartaric acid is very high in oxygen content, whereby the weight ratio of fuel to oxidizer can be relatively high so that a high gas volume per generant weight is generated upon combustion. Also, tartaric acid is relatively inexpensive and readily available.

While tartaric acid is used alone as sole fuel in several gas generant compositions described in U.S. Pat. No. 3,785,149, it is known to use tartaric acid in conjunction with other fuels in gas generant compositions. The present invention is directed to gas generant compositions in which tartaric acid comprises at least about 10 wt %, generally at least about 20 wt%, up to 100%, of the total fuel content of a gas generant composition.

When gas generant compositions are described using tartaric acid as a fuel, it is confidently presumed, where stereochemistry is not defined, that 1-tartaric acid is the form of the tartaric used. This is because 1-tartaric acid, a natural product, is by far the most common and inexpensive form of tartaric acid. 1-tartaric acid is produced by fermentation and is a by-product of wine production. From a pyrotechnic standpoint, there is no difference in performance regardless of the form of tartaric acid, 1-, d- or d, 1-. Accordingly, absent a designation of stereochemistry, when gas generant compositions utilize tartaric acid as fuel, as in U.S. Pat. No. 3,785,149, the use of 1-tartaric acid is understood.

When feasible for a particular gas generant composition, aqueous processing has advantages. In a typical aqueous processing of gas generant, the several components are dissolved and/or slurried in water, typically at between about 10 and about 35 wt% liquid. The slurry is dried and granulated to form prills or can be extruded. Prills or extruded particulates may, if desired, subsequently be compacted into tablets. Generally, prior to compacting, the gas generant composition is assayed for assurance of proper composition. If the composition varies in content from acceptable limits, it may be re-slurried and re-processed with additional ingredients.

Examples of aqueous processing of gas generant compositions are found in U.S. Pat. Nos. 4,994,212 and 5,084,218, the teachings of each of which are incorporated herein by reference.

Water-processing reduces the likelihood of premature combustion during manufacture of pyrotechnic gas generant compositions. Also, water-processing can produce very compact gas generant material, particularly when one or more of the gas generant components is water soluble. The desirability of utilizing, at least in part, a water-soluble fuel in aqueous-processed gas generant material is taught, for example, in U.S. Pat. No. 5,467,715, the teachings of which are incorporated herein by reference.

SUMMARY OF THE INVENTION

In a gas generant composition comprising a fuel and an oxidizer, wherein at least about 10 wt %, up to 100 wt % of the fuel is tartaric acid, it is found that aqueous processing is improved when racemic or d,1-tartaric acid is used, rather than naturally-occurring 1-tartaric acid.

DETAILED DESCRIPTION OF CERTAIN PREFERRED EMBODIMENTS

Gas generant compositions to which the present invention is directed contain a fuel and an oxidizer. The present invention is directed to a wide variety of fuel/oxidizer combinations. Accordingly, based on total weight of fuel plus oxidizer, the fuel may range from about 15 to about 60 wt % of the composition and the oxidizer from about 40 to about 85 wt % of the compositions.

The fuel, in accordance with the invention, is at least in part, tartaric acid, but other fuels known in the art, particularly non-azide fuels, such as tetrazoles, triazoles, salts of dililturic acid and others reported in the patent literature and elsewhere may also be used in conjunction with the tartaric acid as part of the gas generant composition.

Compositions in the present invention may also be formulated with any conventional oxidizer, such as alkali and alkaline earth metal chlorates, perchlorates, and nitrates, as well as with transition metal oxides, such as CuO and $Fe_2O_3$.

As noted above, with aqueous processing of gas generant material, it is considered desirable, e.g., as taught in U.S. Pat. No. 5,467,715, that at least part of the material be water-soluble, e.g., a fuel component or an oxidizer component. Naturally occurring 1-tartaric acid having a solubility in water at 20 C. of 139 g/100 ml would appear, therefor, to be particularly advantageous in aqueous processing. In contrast, d,1-tartaric acid, having a solubility in water at 20 C. of only 20.60 g/100 ml would appear substantially less desirable for aqueous processing. In view of other disadvantages relative to naturally-occurring 1-tartaric acid, i.e., being much less available (and consequently more expensive), there is nothing to suggest the use of d,1-tartaric acid over 1-tartaric acid in any gas generant composition.

However, applicants have found that in aqueous processing, the less soluble d,1-tartaric acid is significantly advantageous over the highly soluble 1-tartaric acid. It is found that the very high solubility of 1-tartaric acid renders gas generant compositions utilizing this form to be very difficult to dry. d,1-tartaric acid, on the other hand, is found to be sufficiently soluble in water to facilitate water-processing, and provides gas generant compositions that may be easily dried. This advantage is realized in initial processing of the gas generant compositions, and also in aqueous re-processing of slightly mis-formulated gas generant material. In fact, it is found, that even where higher levels of water are required for processing gas generant material containing d,1-tartaric material (relative to the amount of water required if the 1- form were used), the compositions containing the d,1-form are much more readily dried. Accordingly, savings are realized both in energy and labor costs.

The advantages of using the d,1- form of tartaric acid are realized whether tartaric acid is the only fuel, as per formulations in U.S. Pat. No. 3,785,149, or where tartaric acid is used in conjunction with other fuels, tartaric acid comprising at least about 10 wt % of total fuel, particularly when comprising at least about 20 wt % of total fuel.

The invention will now be described in greater detail by way of specific examples.

EXAMPLE 1

In accordance with the prior art, a slurry of 1609 gm. of potassium perchlorate and 1114 gm. of 1-tartaric acid was made in 480 gm. of water. This slurry was mixed on a high shear mixer. The slurry was poured into trays to a depth of about 1.90 cm. and dried in a vacuum oven at 90° C., which is the maximum prudent drying temperature of the mixture according to thermal measurements made by accelerating rate calorimetry (ARC). After 2.75 hours, the mixture was screened through a 16 mesh screen and then dried for 3 more hours.

In accordance with the invention, d,1-tartaric acid was substituted for 1-tartaric acid in the formulation. In order to form a mixable slurry, the amount of water needed to be increased to 900 gm. Nevertheless, overall drying time was decreased by 1 hour.

EXAMPLE 2

A slurry of 26.9 kg potassium perchlorate and 18.6 kg 1-tartaric acid was made in 8.0 kg. water. Attempts to process this slurry in a spray dry apparatus modified to manufacture pyrotechnic materials were unsuccessful. d,1-tartaric acid was substituted for 1-tartaric acid in the same formulations. The amount of water had to be increased to 16.4 kg. in order to make a mixable slurry. However, this slurry was easily processed in the spray dry apparatus to yield a dry (less than 0.5 wt % moisture), spherical pyrotechnic composition; yield about 80%.

What is claimed is:

1. In a gas generant composition comprising fuel and oxidizer, at least about 10 wt % of said fuel comprising tartaric acid, the improvement wherein said tartaric acid is d,1-tartaric acid.

2. A mixture of components for forming a gas generant composition comprising fuel and oxidizer, at least about 10 wt % of said fuel comprising tartaric acid, the improvement wherein said tartaric acid is d,1-tartaric acid.

3. A method forming a gas generant composition comprising slurrying fuel and oxidizer in water, at least about 10 wt % of said fuel comprising tartaric acid, and subsequently drying said slurry to remove water and thereby form a dry gas generant composition, the improvement wherein said tartaric acid is d,1-tartaric acid.

* * * * *